US005898378A

United States Patent [19]

Berg et al.

[11] Patent Number: 5,898,378

[45] Date of Patent: Apr. 27, 1999

[54] DRUM LIFT INDICATORS AND INVENTORY CONTROL DEVICES

[75] Inventors: Todd P. Berg, Mundelein; Youfan Wang, Libertyville, both of Ill.

[73] Assignee: Lift-O-Matic Material Handling, Inc., Evanston, Ill.

[21] Appl. No.: 09/020,457

[22] Filed: Feb. 9, 1998

[51] Int. Cl.[6] ..... G08B 21/00

[52] U.S. Cl. ..... 340/679; 414/607; 414/621

[58] Field of Search ..... 340/468, 486, 340/480, 679, 685, 687, 825.17, 815.61; 414/450, 490, 633, 607, 621

[56] References Cited

U.S. PATENT DOCUMENTS

| | | | |
|---|---|---|---|
| 3,893,579 | 7/1975 | Glewwe | 414/607 |
| 4,130,212 | 12/1978 | Gatelao | 414/607 |
| 4,741,659 | 5/1988 | Berg | 414/450 |
| 5,009,565 | 4/1991 | Esau | 414/607 |
| 5,020,963 | 6/1991 | Okada | 414/607 |
| 5,028,753 | 7/1991 | Acuff | 364/424.07 |
| 5,236,298 | 8/1993 | Lehman | 414/607 |
| 5,405,235 | 4/1995 | Lebre et al. | 414/490 |
| 5,496,147 | 3/1996 | Taube | 414/607 |

*Primary Examiner*—Jeffery A. Hofsass
*Assistant Examiner*—Toan N. Pham
*Attorney, Agent, or Firm*—Hill & Simpson

[57] ABSTRACT

The present invention provides new drum lift indicators and inventory control devices for use with drum handling equipment. The drum lift indicators and inventory control devices provide signals indicative of whether drums are properly clamped in the drum lifting equipment. The devices may also provide various other information, for example a count of the number of drums lifted and the amount of time the drum lift indicator and inventory control device is in service. One drum lift indicator and inventory control device according to the present invention has a clamp sensor positioned on a drum lifting clamp, in which the clamp sensor has a sensor signal indicative of whether the drum lifting clamp is clamped onto the drum. A drum clamp indicator is connected to the drum clamp sensor and receives the sensor signal from the clamp sensor. An operator receivable indicator signal is produced by the clamp indicator in response to the sensor signal when the drum lift clamp is clamped onto the drum.

24 Claims, 9 Drawing Sheets

DRUM LIFT INDICATORS AND INVENTORY CONTROL DEVICES

FIELD OF THE INVENTION

The present invention generally relates to drum lifting and handling equipment and more specifically, the present invention relates to drum lift indicators and inventory control devices for drum handling.

BACKGROUND OF THE INVENTION

Drums are widely used containers for holding, storing and transporting various types of materials. Materials contained within drums may include, for example, liquids, chemicals, solids, pellets and a wide variety of other types of materials. Due to the size and weight of drums and the need to safely and efficiently manipulate drums various types of drum handling equipment have been designed. Existing drum handling equipment includes forklift attachments, handmovable lifting trucks, and overhead crane and hoist operated attachments. Drum handling equipment has also been designed to handle single drums or multiple drums, for example, forklift, crane and hoist operated attachments are particularly useful for handling multiple drums.

Drum lifting equipment typically includes a drum lift clamp or mechanism which holds the drum for lifting and transporting of the drum. Existing drum lifting equipment has not included an indicator that the drum is clamped by the drum lifting equipment. Such an indication that the drum is clamped by the drum lifting equipment would be useful for an operator of the device. For example, an operator of a forklift attachment for lifting drums would be informed that the forklift attachment is clamped onto the drum and the forks can then be lifted and the drum transported. Generally, operators who operate drum lifting equipment, such as forklift operators, are unable to see whether the drum lift clamp is properly clamped onto a drum. Accordingly, an advantage would be to provide drum lift equipment operators with a signal indicating whether the drums are properly clamped and ready for lifting and transporting. Providing the drum lift equipment operator with signals indicating whether drums are properly clamped in the drum lift equipment would also improve the safety of lifting and transporting drums.

Existing drum handling equipment has also not provided inventory control and management features. Cost effective management and control of inventory is an objective of many businesses. A variety of information regarding handling of drums may be desirable, for example, counting the number of drums lifted, measuring the weight of drums lifted, and tracking elapsed time of operation of the drum lifting equipment. In addition to inventory management and control of drums and drum contents, information about handling drums may be useful for other purposes, such as maintenance purposes. Drum lifting equipment may be periodically serviced, and tracking the time the drum lifting equipment is in service can assist in proper maintenance of the equipment.

Previously, such information was manually accumulated or in some cases not even acquired at all. For example, the number of drums lifted and transported has been manually counted and drums have been weighed by taking the extra steps of placing the drums on a scale. Accordingly, it would advantageous to automatically track various information pertaining to drum lifting and transporting.

Therefore, there would be advantages to having new drum lifting equipment, particularly drum lifting indicators and inventor control devices. One specific advantage would be to have a drum lift indicator which indicates to the equipment operator that the drum is properly clamped in the lifting equipment. Another advantage would be to have a drum lift inventory control device which counts the number of drums lifted. Another advantage would be to have drum lift equipment which measures the weight of the drums when the drums are lifted. Yet another advantage would be to have drum lift equipment which assists in maintaining the equipment by providing information on use of the equipment. Other advantages of having new drum lift equipment will become apparent in view of the present invention.

SUMMARY OF THE INVENTION

The present invention provides new drum lift indicators and inventory control devices for use in handling drums with drum lifting equipment. The new drum lift indicators and inventory control devices provide a signal to the operator of the lifting equipment indicative of whether the drums are properly clamped for lifting and transporting. The drum lift indicators and inventory control devices may also provide various information on lifting and transporting drums. For example, the drum lift indicators and inventory control devices may count the number of drums lifted with a counter. The counter may continuously count the number of drums lifted or the counter may be resettable. Also, multiple counters can be used to count any desired actions taken during drum handling.

The drum lift indicators and inventory control devices may also measure the weight of the drums and the drum contents when the drums are lifted by a weight sensor, such as a pressure sensor, and a weight counter. The weight tracking feature of the present invention may indicate whether the drums are empty, partially full or full. The weight counter may track accumulative weight of drums or it may be resettable depending on the information desired and the type of weight counter. The weight counter may have a memory feature which could be set to a full drum weight or which could be auto set upon lifting a drum.

The drum lift indicators and inventory control devices may also accumulate information helpful in servicing the drum lifting equipment. For example, the present invention may track the amount of time the drum lifting equipment is in service. Such information may be helpful in periodically servicing the drum lifting equipment.

The new drum lift indicators and inventory control devices may be used with a variety of drum lifting equipment. For example, the drum lift indicators and inventory control devices may be used with forklift drum handling attachments, which may lift one or more drums. The present invention may also be used with other types of drum handling equipment, such as crane and hoist operated drum handling equipment and hand moveable drum lifting trucks or carts. The drum lift indicator feature of the present invention is particularly useful on drum lifting equipment in which the equipment operator may not be able to readily determine whether the drum lifting clamps are properly clamped on the drums. A forklift truck operator utilizing a forklift attachment for lifting drums may not be able to see whether the drum clamps are properly clamped onto the drum because the operator's view of the drum clamps may be obscured or blocked. To alleviate this problem, the present invention provides the forklift truck operator with a signal indicative of whether the drum clamps are properly clamped onto the drums.

One drum lift indicator device according to the present invention is useable with a drum lifting clamp for clamping and lifting drums. The drum lift indicator device includes a clamp sensor, an indicator, and an operator receivable indicator signal. The clamp sensor is positioned approximate the drum lifting clamp and has a signal output port. The clamp sensor also has a sensor signal indicative of whether the drum lifting clamp is clamped onto the drum. The sensor signal is output from the clamp sensor through the signal output port. The indicator has a signal input port connected to the signal output port of the clamp sensor. The signal input port receives the sensor signal through the signal output port of the clamp sensor. An operator observable signal emanates from an indicator in response to the sensor signal when the drum lift clamp is clamped onto the drum.

Another drum lift indicator device according to the present invention is useable with at least first and second drum lifting stations in which each station is capable of clamping and lifting at least one drum. The drum lift indicator device includes first and second clamp sensors, a control circuit, and a signal producer, such as a strobe light. The first clamp sensor is positioned proximate the first drum lifting station and has a first sensor signal indicative of whether the first drum lifting station is clamped onto one of the drums. The second clamp sensor is positioned proximate the second drum lifting station and has a second sensor signal indicative of whether the second drum lifting station is clamped onto one of the drums. The control circuit is electrically connected to the first and second clamp sensors and receives the first and second sensor signals. The strobe light signal producer is electrically connected to the control circuit and produces a flashing light or other signal to the operator when at least one of the first and second sensor signals indicates that a drum is clamped by one of the first and second lift stations.

Each of the drum lifting stations may include a pair of drum lift clamps, such as chine clamps, in which each drum lift clamp has a clamp sensor connected to the control circuit. The drum lift indicator device may further include first and second clamp indicator lights electrically connected to the control circuit. The first and second indicator lights have a red light indicative of the drum lifting stations not being clamped onto one of the drums, and a green light green light indicative of the drum lifting stations being clamped onto the drums.

The present invention provides new drum lift indicators and inventory control devices for use with drum handling equipment to handle drums. The new drum lift indicators and inventory control devices provide convenient and cost effective ways of handling and transporting drums, and maintaining drum handling equipment. An advantage of the present invention is to provide new drum lift indicators and inventory control devices which overcome deficiencies of existing drum handling equipment. Furthermore, the present invention improves safety, productivity and profitability in drum handling.

Another advantage of the present invention is to provide drum lift indicators which indicate to the operator of the lifting equipment whether a drum is clamped by the drum lifting equipment.

Another advantage of the present invention is to provide automated drum inventory tracking, such as counting the drums clamped.

Another advantage of the present invention is to provide drum lift indicators and inventory control devices which measure the weight of drum lifted.

Another advantage of the present invention is to provide drum lift indicators and inventory control devices which assist in maintenance of the drum lifting equipment, such as by tracking the amount of use of the drum lifting equipment.

Another advantage of the present invention is to improve safety when handling drums.

Another advantage of the present invention is to automatically accumulate desired information on handling drums.

Other advantages of the present invention will become apparent upon reading this disclosure including the appended claims and with reference to the accompanying drawings.

DETAILED DESCRIPTION OF PRESENTLY PREFERRED EMBODIMENTS

Although the present invention can be made in many different forms, the presently preferred embodiments are described in this disclosure and shown in the attached drawings. This disclosure exemplifies the principles of the present invention and does not limit the broad aspects of the invention only to the illustrated embodiments.

Figure 1:
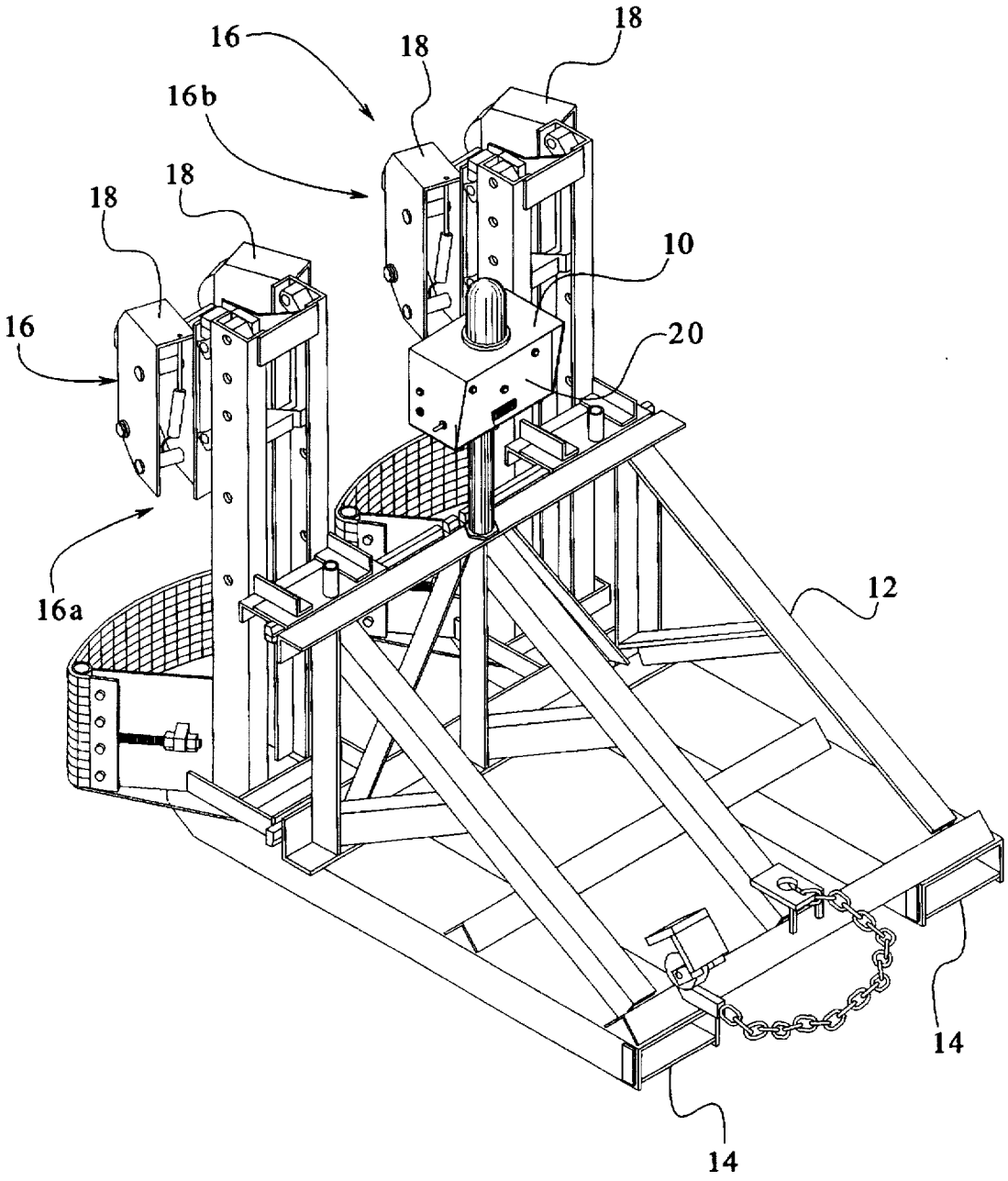
FIG. 1 is a perspective view of a drum lift indicator and inventory control device according to the principles of the present invention mounted on a forklift attachment for handling drums.
Figure 2:
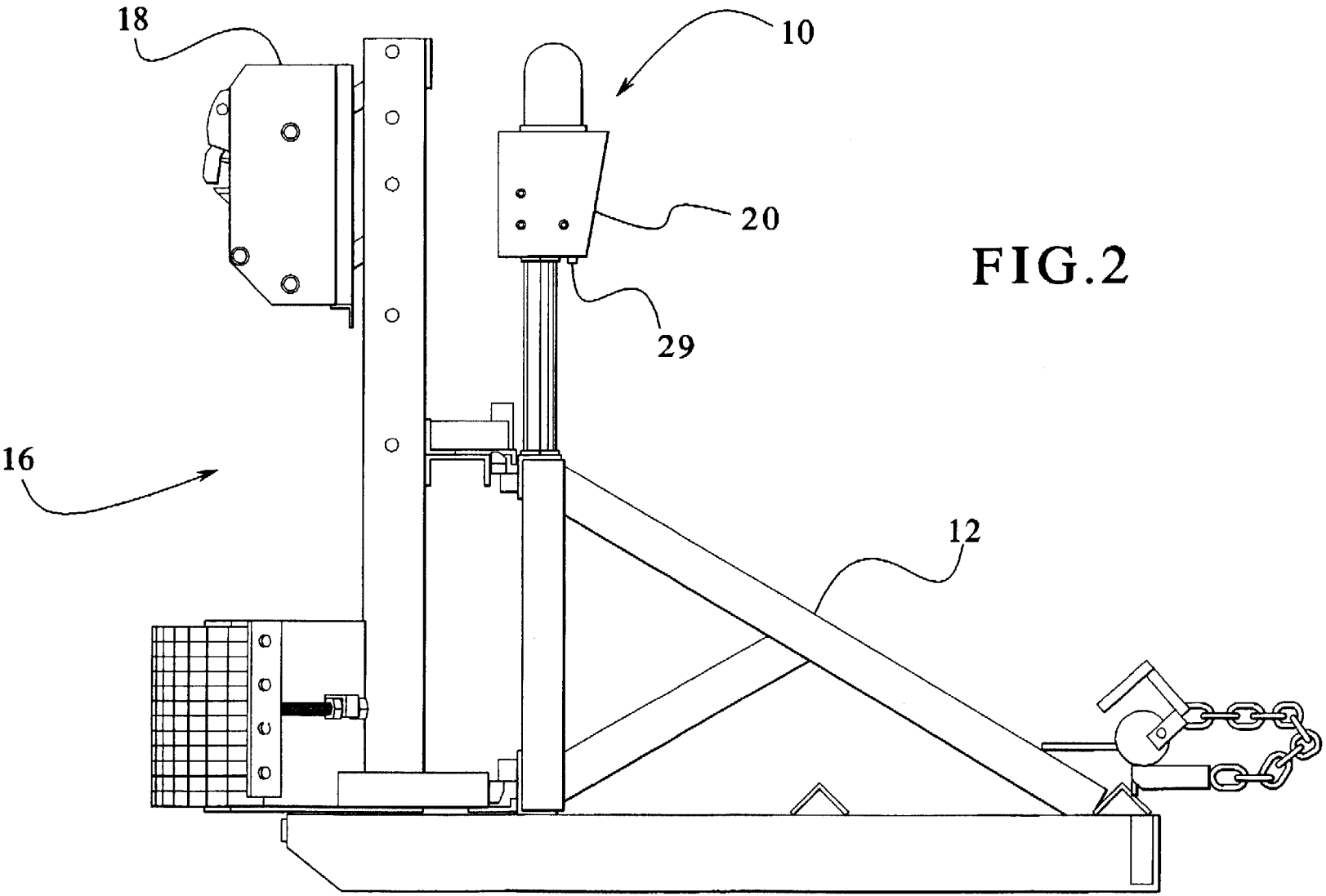
FIG. 2 is a side elevational view of the drum lift indicator and inventory control device on the forklift attachment of FIG. 1.

A new drum lift indicator and inventory control device 10 according to the principles of the present invention is shown by way of example in FIG. 1. The drum lift indicator and inventory control device 10 is mounted to a drum lifting forklift attachment 12. However, the drum lift indicator and inventory control device 10 can be used on other types of drum lifting equipment, such as crane operated drum lifting equipment, for example. The drum lifting forklift attachment 12 has a pair of fork channels 14 for mounting the forklift attachment 12 to a forklift truck. The forklift attachment 12 also has dual drum lifting stations 16 for clamping, lifting and transporting drums. Each drum lifting station 16 has a pair of drum lift clamp mechanisms 18 which both clamp onto a single drum in one of the drum lifting stations 16. As can be seen in FIGS. 1 and 2, a front panel 20 of the drum lift indicator 10 faces the forklift truck and the operator who operates the forklift truck.

The drum lift indicator and inventory control device 10 includes at least one switch or sensor in each one of the drum lift clamp mechanisms 18, as described in more detail below. For example, each drum lift clamp mechanism 18 may include a switch which indicates whether the drum lift clamp mechanism 18 is unclamped or clamped onto a drum. Other sensors or switches or multi capability signal rendering devices may also be included in the drum lift indicator and inventory control device 10 to sense any desired characteristic or information regarding lifting and carrying drums. For example, a weight sensor may be included to measure the weight of a drum which is lifted. The switches and sensors of the drum lift indicator and inventory control device are preferably connected to the drum lift clamp mechanisms 18, but may be positioned at any appropriate location on the drum lifting equipment.

The drum lift indicator and inventory control device 10 as shown in FIGS. 1 and 2 as configured for a dual drum lifting station 16 in which each lifting station 16 has a pair of drum lift clamp mechanisms 18. However, the drum lift indicator and inventory control device of the present invention can by used with other configurations of drum lifting equipment. Drum lifting equipment may have a single drum lifting station or multiple drum lifting stations, such as four lifting stations. Also, each drum lifting station may have one or more drum lift clamp mechanisms. Accordingly, drum lift indicator and inventory control devices according to the present invention can be used with various configurations of drum lifting equipment.

Figure 3:
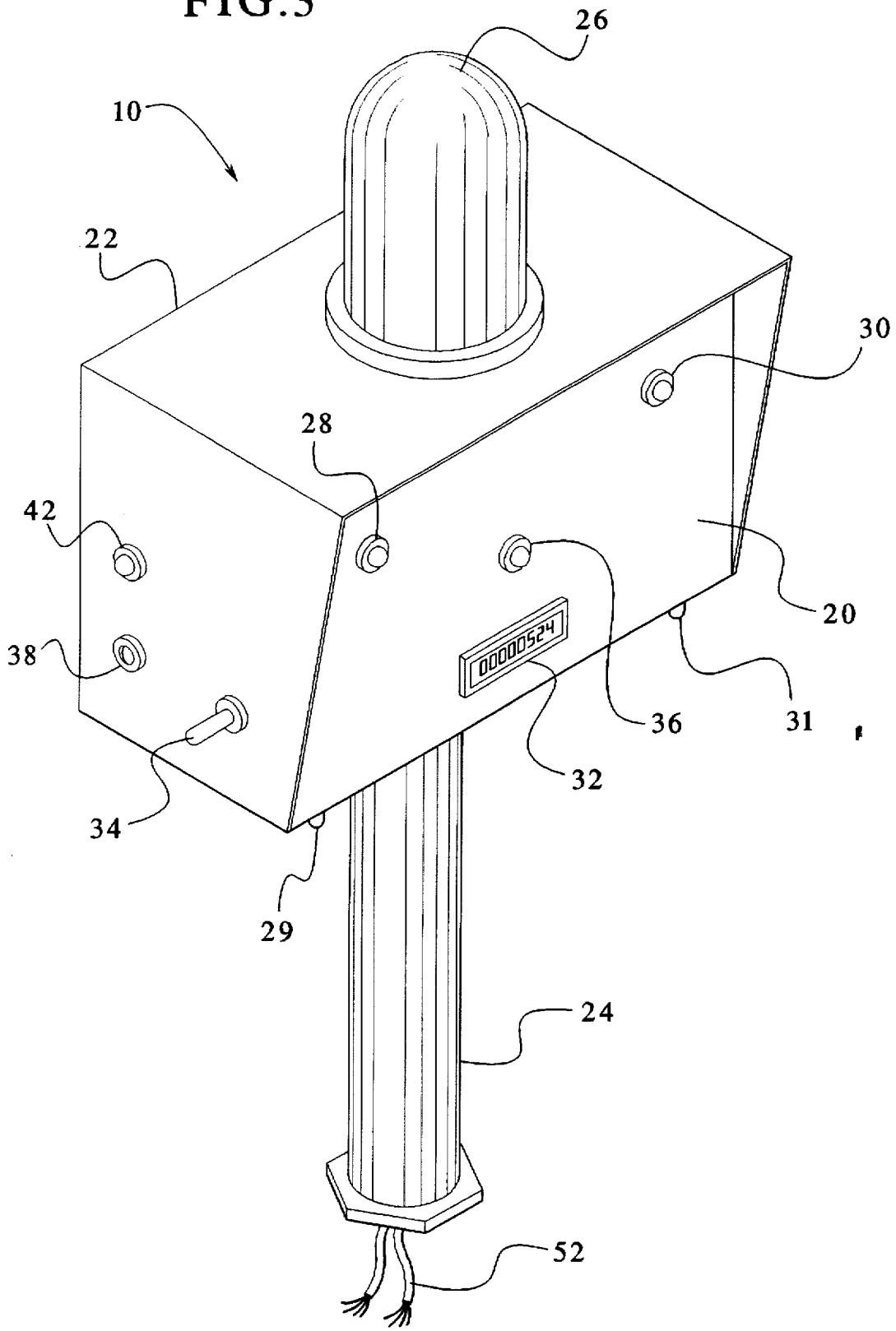
FIG. 3 is perspective view of the drum lift indicator and inventory control device of FIG. 1.

Referring to FIG. 3, the drum lift indicator and inventory control device 10 includes a case 22 mounted to a upstanding post 24. The height of the post 22 can be selected to provide the forklift truck operator with a clear line of sight to the drum lift indicator 10. A strobe light 26 is provided on the case 22 and flashes when a drum is properly clamped in at least one of the drum lifting stations 16. Accordingly, the strobe light 26 provides an operator receivable signal which indicates whether a drum is properly clamped in a drum lifting station 16 as well as a warning to others in the area.

Left and right signal lights 28, 30 are provided on the front panel 20 of the case 22. The left signal light 28 is preferably a dual LED light having alternate red and green colors. The left signal light 28 has a red color when a drum is not properly clamped in the left drum lifting station 16*a*, and has a green light when a drum is properly clamped in the left drum lifting station 16*a*. The right signal light 30 operates similarly for drums that are clamped or unclamped in the right drum lifting station 16*b*. In this manner, the left and right signal lights 28, 30 provide operator receivable signals which indicate whether a drum is properly clamped in either of the left and right drum lifting stations 16*a*, 16*b*.

In addition to the left and right signal lights 28, 30 provided on the front panel 20 of the case 22, other signal lights indicating whether a drum has been captured in either of the left and right drum lifting stations 16*a*, 16*b* may be provided. For example, a second left signal light 29 and a second right signal light 31 may be provided on a bottom panel of the case 22. The left and right signal lights 29, 31 on the bottom panel have the same red and green colors as the left and right signal lights 28, 30 on the front panel 20. The bottom panel left and right signal lights 29, 31 may be particularly useful when the forklift attachment 12 is raised upward and the forklift operator can view the bottom of the drum lift indicator and inventory control device.

At the start of a drum lift operating, the operator of the drum lifting equipment will know whether one or both drum lifting stations 16 have properly engaged the drum, such as by clamping the chine and whether the device will be ready for lifting a drum. The strobe light 26 and the left and right signal lights 28, 29, 30, 31 provide visual signals to the drum lifting equipment operator informing the operator whether the drums desired to be picked up are properly clamped in each of the drum lifting stations 16. The drum lifting equipment operator will be informed by the strobe light 26 or other device whether any of the drum lifting stations are properly clamped onto a drum. The drum lifting equipment operator will be further informed whether each particular drum lifting station 16 is properly clamped onto a drum by the left and right signal lights 28, 29, 30 31 depending on whether the left or right signal lights are red or green. Accordingly, the drum lift indicator and inventory control device enhances the safety of lifting and transporting drums because the drum lifting equipment operator is informed of whether the drums are properly clamped in the drum lifting equipment.

The drum lift indicator and inventory control device 10 is shown as having visual indicators, i.e. lights. However, the present invention may include other types of indicators such as audio signals, touch sensitive signals located near the operator, and combinations thereof.

A drum counter 32 is provided on the drum lift indicator and inventory control device 10 to count the number of drums that are lifted. The operation of the drum counter 32 will be described more fully below. Other counters, meters, lights or any other indicator may also be included on the drum lift indicator and inventory control device as needed. For example, a time counter (identified by reference number 33 in FIG. 9) may be provided which measures the length of time that the drum lift indicator and inventory control device is turned on. The time counter 33 may be useful in tracking the length of time that the drum lift equipment is in operation for maintenance purposes. The time counter 33 may be mounted to the front panel 20 next to the drum counter 32.

The drum lift indicator and inventory control device 10 includes an power switch 34 for turning the device on and off, and a power on and off indicator light 36. A power jack 38 is provided to charge a battery 40 (FIG. 4) which is contained within the case 22. A charge indicator light 42 is provided to indicate the level of the charge of the battery 40. Although the drum indicator and inventory control device 10 includes a battery 40 to supply power, the present invention contemplates using other power sources, such as power provided from the drum lifting equipment.

Figure 4:
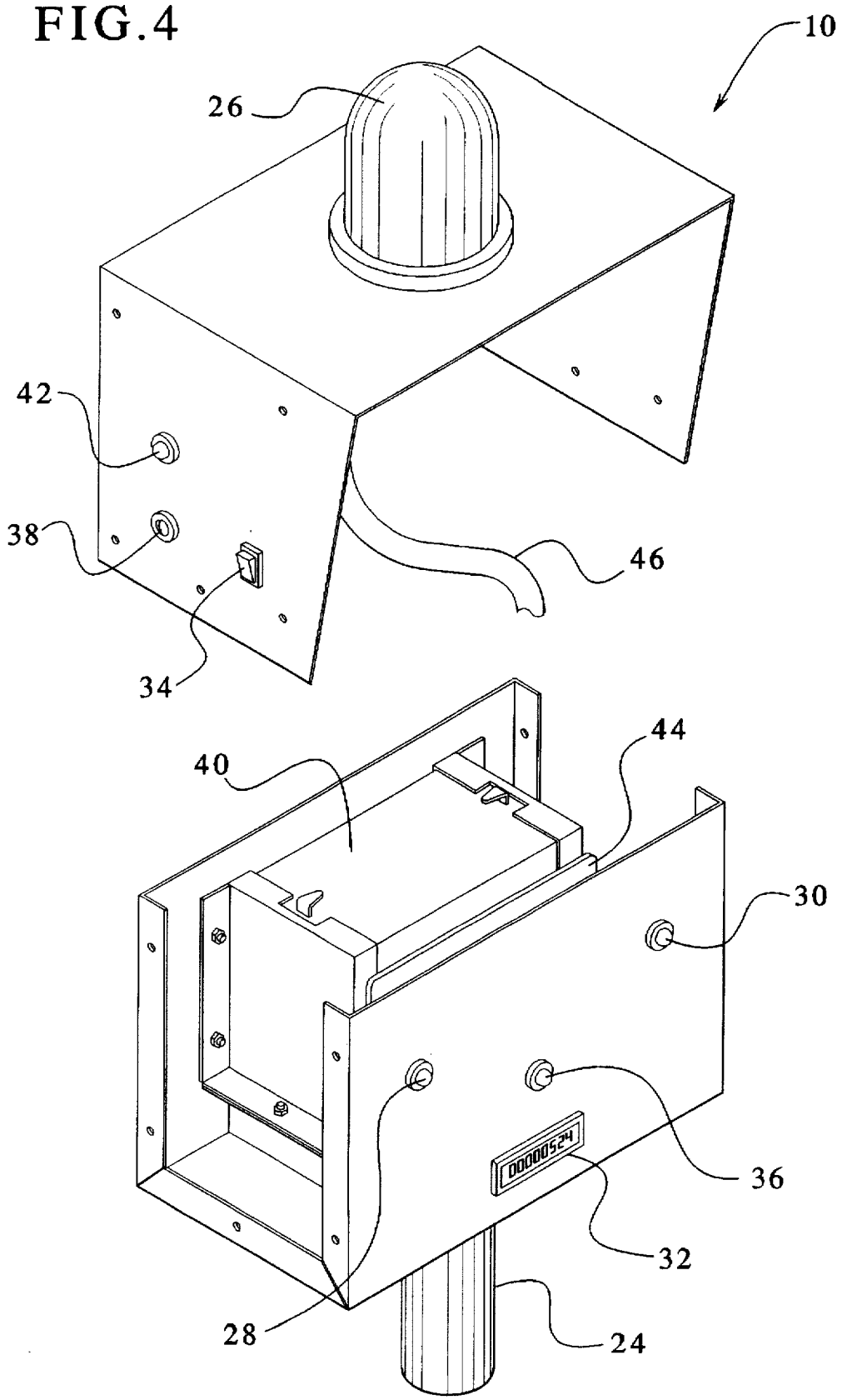
FIG. 4 is a partial exploded view of the drum lift indicator and inventory control device of FIG. 3.
Figure 5:
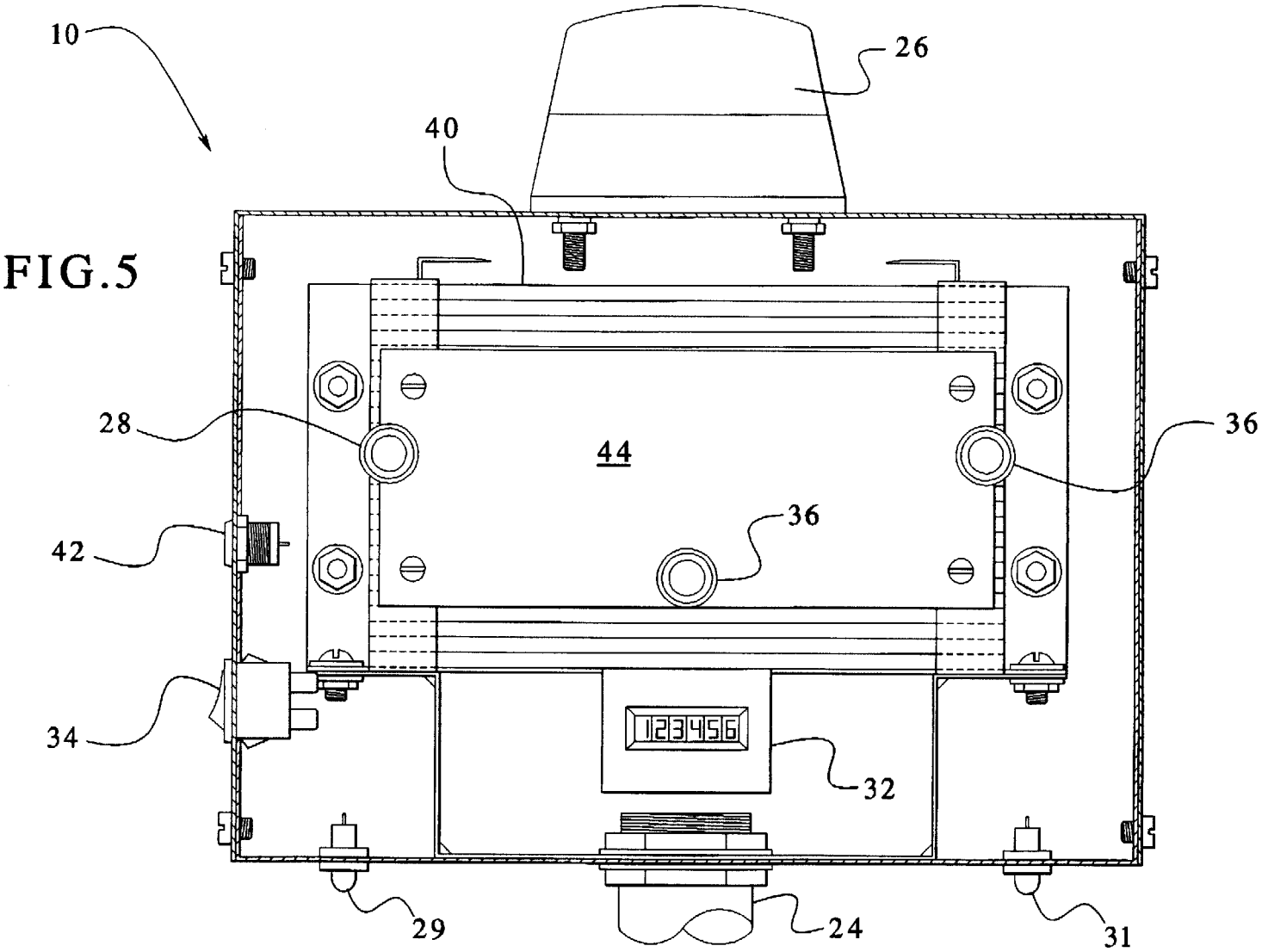
FIG. 5 is a front elevational view of the drum lift indicator and inventory control device of FIG. 3 with a front panel broken away.
Figure 6:
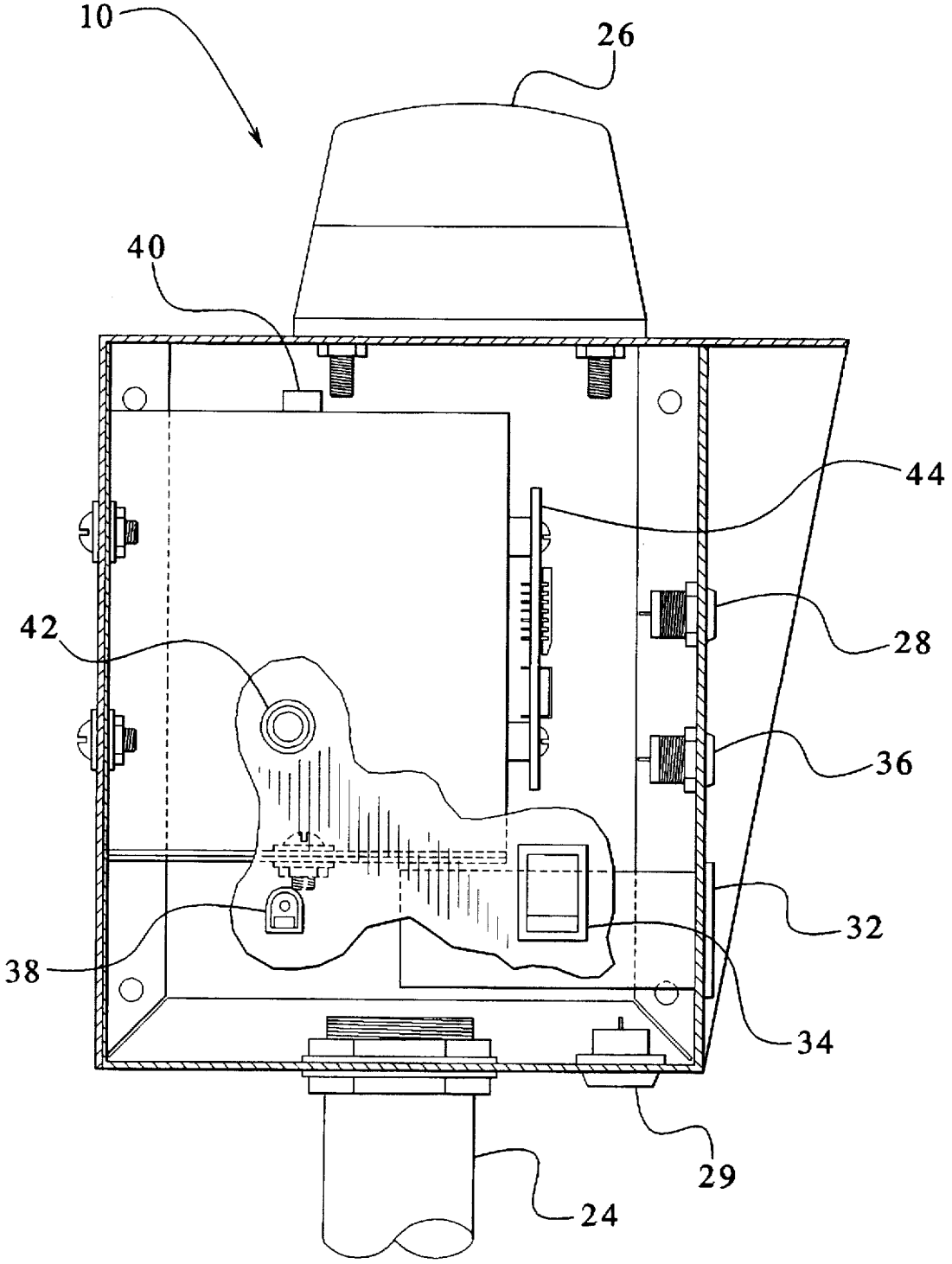
FIG. 6 is a left side elevational view of the drum lift indicator and inventory control device of FIG. 3 with a side panel broken away.

Referring to FIGS. 4–6, the drum lift indicator and inventory control device 10 includes a control circuit 44. The control circuit 44 is electrically connected the various electrical components of the drum lift indicator 10. For example, the control circuit 44 is connected to the strobe light 26, the power switch 34 and the charge indicator 42 by a cable 46, in which those components are mounted to a case top 48 as shown in FIG. 4. The control circuit 44 is, of course, also electrically connected to the battery 40, the left and right signal lights 28, 29, 30, 31, the power on and off indicator light 36, the drum counter 32 and any other indicators.

Figure 8:
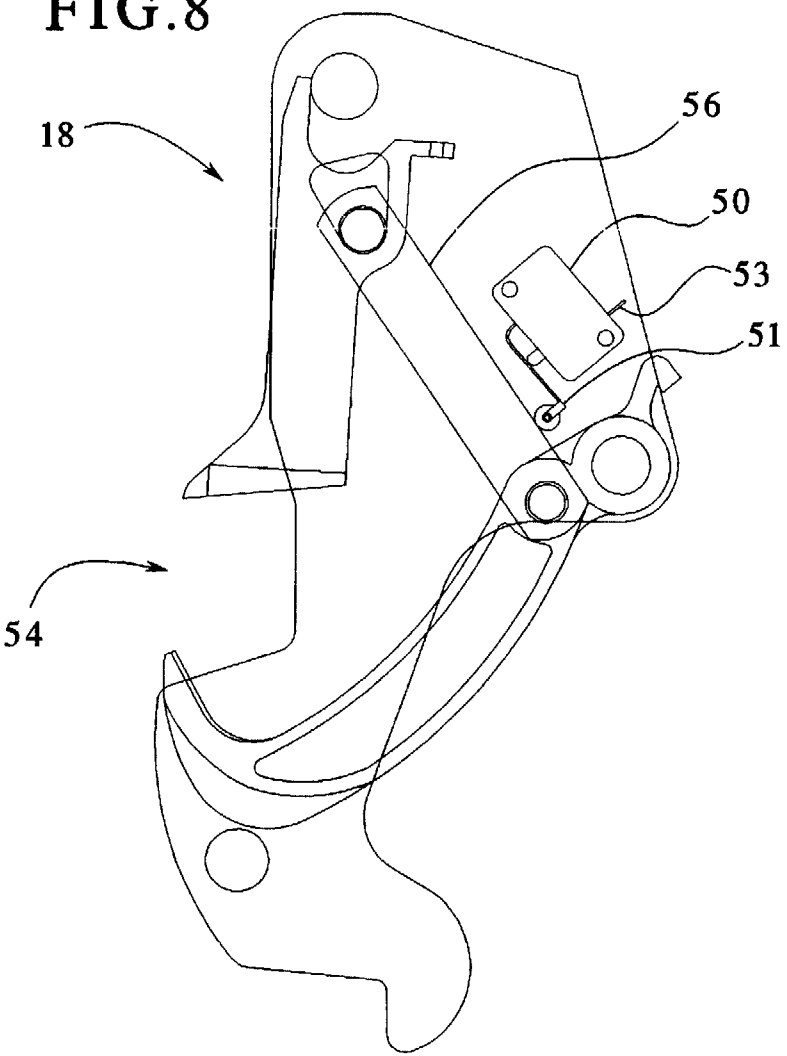
FIG. 8 is a side elevational view of the drum clamp of FIG. 7 showing the drum clamp mechanism in a clamped position.
Figure 7:
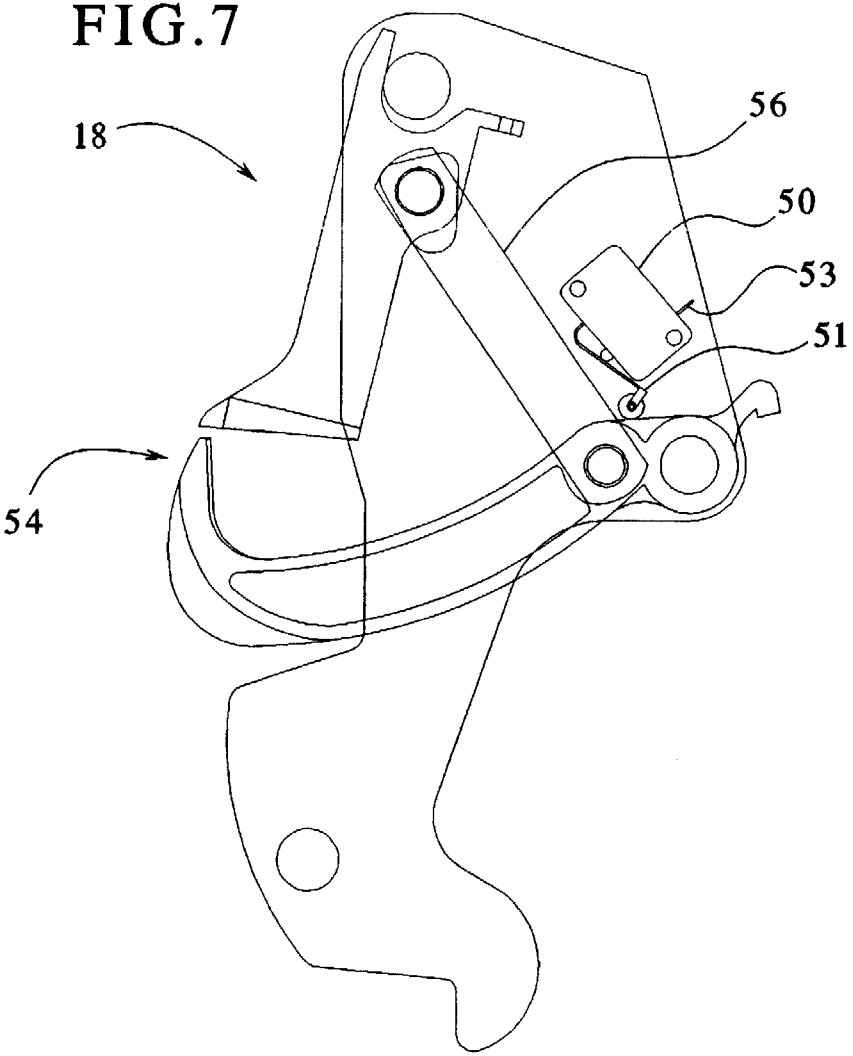
FIG. 7 is an elevational view of a drum clamp mechanism useable with the drum lift indicator and inventory control device of FIG. 3, showing the drum clamp in an unclamped position.

Referring to FIGS. 7 and 8, the drum lift clamp mechanisms 18 are commonly known in the industry as Parrot- Beak® clamps available from Lift-O-Matic Material handling as shown in U.S. Pat. No. 4,741,659, the teachings of which are incorporated herein. However, the present invention may also be used with other drum lift clamp mechanisms. The drum lift indicator and inventory control device 10 includes a clamp switch 50, such as a microswitch, mounted to the drum lift clamp mechanism 18. The clamp switch 50 senses whether the drum lift clamp mechanism 18 is properly clamped onto a drum and sends a signal via wires 52 (FIG. 3) to the control circuit 44 (FIG. 6). FIG. 7 shows the drum lift clamp mechanism 18 in a position in which the drum lift clamp mechanism 18 is not properly clamped onto a drum. Particularly, jaws 54 of the drum lift clamp mechanism 18 are in a position in which the jaws 54 are not clamped onto a drum. Accordingly, a portion 56 of the drum lift clamp mechanism 18 places a switch arm 51 (and the clamp switch 50) in a position which indicates that the drum lift clamp mechanism 18 is not properly clamped onto a drum.

When the drum lift clamp 18 is properly clamped onto a drum, the drum lift clamp mechanism will be in the position as shown in FIG. 8. The jaws 54 in and the portion 56 of the drum lift clamp mechanism 18 are in a position of being clamped onto a drum which places the clamp switch 50 in a position which indicates that the drum is clamped by the drum lift clamp mechanism 18. In this manner, the clamp switch 50 provides a signal to the control circuit 44 via an electrical switch connection 53 indicative of whether a drum is properly clamped into the drum lift clamp mechanism 18.

The drum lift clamp mechanism 18 may be placed in the unclamped position shown in FIG. 7 for various reasons. One reason may include that there is no drum in the drum lifting station 16 which contains that particular drum lift clamp mechanism 18. Another reason may be that a drum in the drum lifting station 16 was not properly clamped by the drum lift clamp mechanism 18. This may happen when the operator attempts to clamp onto the drum, but the drum lift clamp mechanism 18 slips off of the drum and the jaws 54 do not properly grab the drum chine.

Figure 9:
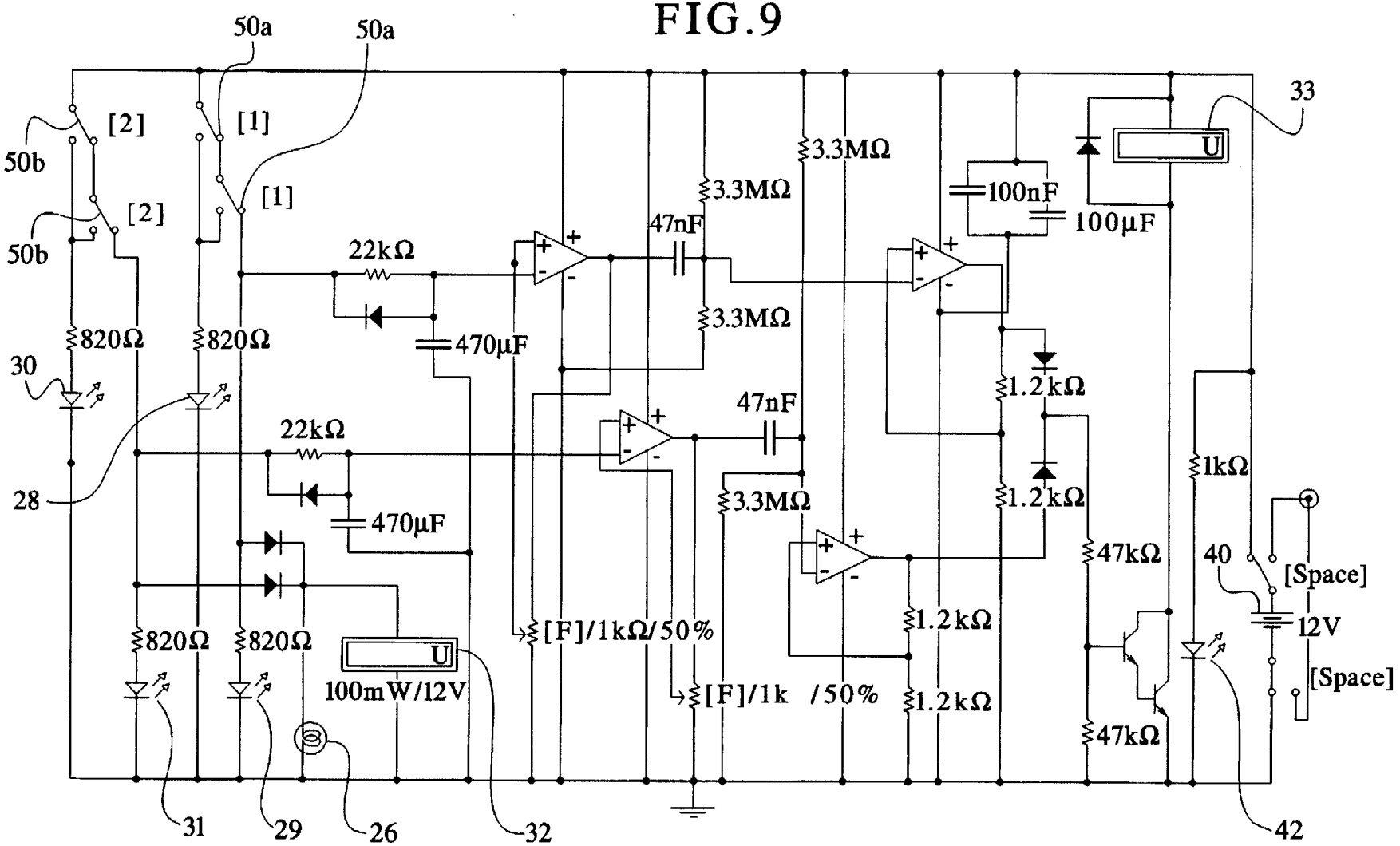
FIG. 9 is a circuit diagram showing the control circuit for the drum lift indicator and inventory control device of FIG. 1.

FIG. 9 shows a circuit diagram of the control circuit 44. Various components of the drum lift indicator and inventory control device are labeled in FIG. 9 to show their connection to the control circuit 44. The strobe light is identified as reference numeral 26, the left and right LED signal lights on the front panel 20 are identified by reference numerals 28, 30 respectively. The left and right LED signal lights 29, 31 which are located on the bottom of case 22 are shown by reference numerals 29 and 31 respectively. The battery is identified by reference numeral 40 and the charge indicator light by reference numeral 42. The drum counter is identified by reference numeral 32 and the elapsed time meter is identified by reference numeral 33. The pair of clamp switches 50 on the drum lift clamp mechanism 18 for the left drum lifting station 16*a* are identified by reference numerals 50*a*. The pair of clamp switches 50 on the drum lift clamp mechanism 18 for the right drum lifting station 16*b* are identified by reference numerals 50*b*.

Operation of the drum lift indicator and inventory control device will now be briefly described. Referring to FIG. 3, the power switch 34 is thrown to turn the power on to the drum lift indicator and inventory control device 10, which also turns the power indicator light 34 on and starts the timer meter 33 (FIG. 9). In this initial condition, the strobe light 26 is off and the left signal lights 28, 29 and the right signal lights 30, 31 are red.

The operator positions the drum lifting forklift attachment 12 in position to pick-up one or two drums. The drum lift clamp mechanisms 18 are lowered onto a drum to grab the chine of the drum in the jaws 54 of the drum lift clamp mechanisms 18. If a drum is properly clamped in either of the drum lifting stations 16, the strobe light 26 begins to flash. The left signal lights 28, 29 and the right signal lights 30, 31 will change from red to green if a drum is properly grabbed in the corresponding left or right drum lifting station 16*a*, 16*b*. Both drum lift clamp mechanisms 18 for a particular drum lifting station 16 must properly grab a drum to change the signal light from red to green. This insures that a drum is properly clamped by both clamps before lifting. The operator of the drum lifting equipment can visually identify whether each drum is properly clamped in its drum lifting station 16 by the strobe light 26 and the left and right signal lights 28, 29, 30, 31.

Figure 10:
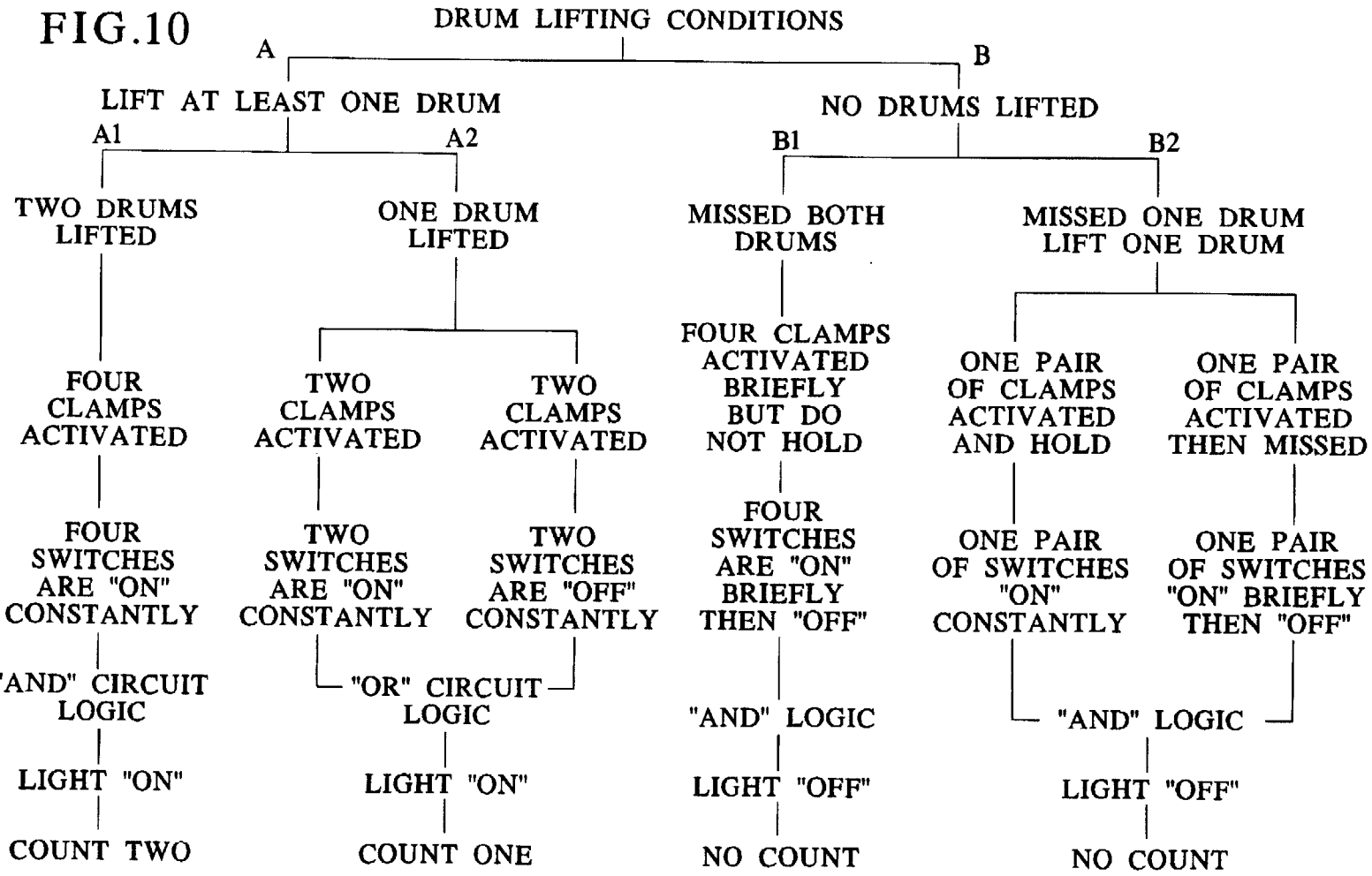
FIG. 10 is a chart showing the logic of the control circuit of the drum lift indicator and inventory control device of FIG. 1.

Operation of the left and right signal lights 28, 29,. 30, 31 and the drum counter 32 will be described with reference to the chart of FIG. 10. The chart of FIG. 10 shows various conditions which may be encountered by the drum lift indicator and inventory control device 10. Branch A shows the logic when one or two drums are lifted and counted, and branch B shows the logic when no drums are lifted or counted. Referring to branch A1, the LED signal lights 28, 29, 30, 31 are changed to green and the drum counter 32 counts two drums as being lifted. Four drum lift clamp mechanisms 18 (two mechanism per drum lifting station 16) are clamped onto two drums, one drum in each drum lifting station 16. The four clamp switches 50 are activated or "on" constantly. All of the left and right signal lights 28, 29, 30, 31 are placed in an "on" condition i.e., changed from red to green.

Branch A2 shows the logic when only one drum is lifted. Two drum lift clamp mechanisms 18 in one drum lifting station 16 are activated, and the two corresponding clamp switches 50 are "on" constantly. One or both of the drum clamp mechanisms 18 in the other drum lifting station 16 is not actuated and the corresponding clamp switches 50 in that other drum lifting station 16 are "off" constantly. Accordingly, only one drum is clamped into one drum lifting station 16 and the corresponding left or right indicator lights are turned on to green and only one drum is counted.

Branch B shows the operating logic when no drums are lifted. Branch B1 refers to the situation where both drum lifting stations 16 attempt to grab a drum but fail. This may happen when all four drum lift clamp mechanisms 18 attempt to grab a drum but slip and do not grab. During the slipping process, the drum lift clamp mechanisms 18 may briefly trip the clamp switches 50 to a clamped position and then return the clamp switches 50 to the unclamped position. In this case, the strobe light 26 would be off, and the left and right signal lights 28, 29, 30, 31 would be red. The drum counter 32 would not count a drum as being lifted. The branch B1 not only applies when both drum lift clamp mechanisms 18 in a drum lifting station 16 miss a drum, but also applies when one of the two drum lift clamp mechanisms 18 in a drum lifting station 16 misses a drum while the other drum lift clamp mechanism catches a drum. The drum lifting conditions described in branches A1, A2 and B1 of FIG. 10 are included in the control circuit 44 of the drum lift indicator and inventory control device 10.

The branch B2 is not included in the control circuit 44 but could be added if desired. The situation shown in branch B2 may occur when the operator attempts to lift two drums, but only one drum is lifted and the other drum is not lifted. The pair of clamp switches 50 associated with the drum lifting station 16 which grabs a drum would provide a constant "on" signal while the clamp switches 50 associated with the drum lifting station 16 which missed or slipped on the drum might be briefly "on" and then in an "off" position. The indicator lights would be off and no drums would be counted. The operator would then attempt a second time to lift the missed drum and if successful the indicator lights would be switched on and the two drums would be counted.

While the presently preferred embodiments have been illustrated and described, numerous changes and modifications can be made without significantly departing from the spirit and scope of this invention. Therefore, the inventors intend that such changes and modifications are covered by the appended claims.

The invention is claimed as:

1. A drum lift indicator device useable with a drum lifting clamp for clamping and lifting drums comprising:

a clamp sensor positioned proximate the drum lifting clamp and having a signal output port, the clamp sensor having a sensor signal output from the signal output port and indicative of whether the drum lifting clamp is clamped onto the drum;

an indicator having a signal input port connected to the signal output port of the clamp sensor, the signal input port receiving the sensor signal through the signal input port; and an operator receivable indicator signal emanating from the indicator in response to the sensor signal when the drum lift clamp is clamped onto the drum.

2. The drum lift indicator device of claim 1 wherein the indicator comprises an electronic control circuit connected to a power source.

3. The drum lift indicator device of claim 1 wherein the operator receivable indicator signal emanating from the indicator is a light that flashes when the drum lift clamp is clamped onto the drum.

4. The drum lift indicator device of claim 1 further comprising a second operator receivable indicator signal emanating from the indicator in response to the sensor signal, the second operator receivable indicator signal having a first indication that the drum clamp is clamped onto the drum and a second indication that the drum clamp is unclamped on the drum.

5. The drum lift indicator device of claim 4 wherein the second operator receivable indicator signal is a two colored light wherein the light has a first color display when the sensor signal indicates the drum clamp is clamped onto the drum and a second color display when the sensor signal indicates the drum clamp in unclamped on the drum.

6. The drum lift indicator device of claim 1 further comprising a counter having a counter input port connected to the signal output port of the clamp sensor, the counter receiving the sensor signal through the counter input port, wherein the counter counts each drum which is clamped by the drum lifting clamp in response to the sensor signal.

7. The drum lift indicator device of claim 1 further comprising:

a weight indicating sensor positioned proximate the drum lifting clamp and having a weight signal output port, the weight indicating sensor having a weight signal indicative of the weight of the drum and being output from the weight indicating sensor through the weight signal output port; and a weight tracking device having a weight signal input port connected to the weight signal output port of the weight indicating sensor, the weight signal input port receiving the weight signal through the weight signal input port.

8. The drum lift indicator device of claim 1 wherein the operator receivable indicator signal emanating from the indicator is selected from the group consisting of visual signals, audio signals, touch signals, and combinations thereof.

9. The drum lift indicator of claim 1 further comprising a measurement device associated with the drum lifting clamp and capable of measuring a desired characteristic of the drum.

10. The drum lift indicator of claim 9 wherein the desired characteristic of the drum is selected from the group consisting of the number of drums lifted, the weight of the drums lifted, the length of time the drums are lifted, the length of time the drum lift indicator is in use and combinations thereof.

11. A drum lift indicator device useable with at least first and second drum lifting stations, each station capable of clamping and lifting at least one drum, the drum lift indicator device comprising:

a first clamp sensor positioned proximate the first drum lifting station and having a first sensor signal indicative of whether the first drum lifting station is clamped onto one of the drums;

a second clamp sensor positioned proximate the second drum lifting station and having a second sensor signal indicative of whether the second drum lifting station is clamped onto one of the drums;

a control circuit electrically connected to the first and second clamp sensors and receiving the first and second sensor signals; and a signal producer electrically connected to the control circuit and having a drum clamped signal emanating from the signal producer when at least one of the first and second sensor signals indicates at least one of the drums is clamped by at least one of the first and second lift stations.

12. The drum lift indicator device of claim 11 wherein the drum clamped signal emanating from the signal producer is selected from the group consisting of visual signals, audio signals, touch signals, and combinations thereof.

13. The drum lift indicator device of claim 12 further comprising:

a first clamp indicator electrically connected to the control circuit and having a first clamp indicator signal indicative of whether the first drum lifting station is clamped onto one of the drums; and a second clamp indicator electrically connected to the control circuit and having a second clamp indicator signal indicative of whether the second drum lifting station is clamped onto one of the drums.

14. The drum lift indicator device of claim 13 further comprising a counter electrically connected to the control circuit, wherein the counter counts each drum that is clamped.

15. The drum lift indicator device of claim 14 further comprising first and second weight indicating sensors positioned proximate the first and second drum lifting stations, respectively.

16. The drum lift indicator device of claim 15 wherein the drum clamped signal emanating from the signal producer is a flashing light.

17. The drum lift indicator device of claim 15 wherein each one of the first and second clamp indicators is a two colored light.

18. The drum lift indicator device of claim 11 wherein each of the drum lifting stations comprises a pair of drum lift clamps, each drum lift clamp having a clamp sensor connected to the control circuit.

19. The drum lift indicator device of claim 18 further comprising:

a first clamp indicator electrically connected to the control circuit and having a first clamp indicator signal indicative of whether both of the pair of drum clamps of the first drum lifting station are clamped onto one of the drums; and a second clamp indicator electrically connected to the control circuit and having a second clamp indicator signal indicative of whether both of the pair of drum clamps of the second drum lifting station are clamped onto one of the drums.

20. A method of indicating whether a drum clamp is clamped onto a drum comprising the steps of:

sensing whether the drum clamp is clamped onto the drum with a sensor;

outputting a sensor signal from the sensor when the drum clamp is clamped onto the drum;

inputting the sensor signal to an indicator capable of producing an operator receivable indicator signal indicative of whether the drum clamp is clamped onto the drum; and producing the operator receivable indicator signed from the indicator.

21. The method of claim 20 further comprising the step of counting each drum which is clamped in the drum clamp.

22. The method of claim 20 further comprising the step of measuring the weight of each drum lifted in the drum clamp.

23. A signaling device for drum lifting equipment comprising drum engaging clamps for grasping a drum, the clamps being carried by a movable support movable to lift the clamps and clamp a drum, a sensor affixed to at least one of the clamps and effective to output a signal when the clamp has engaged a drum in a secure lifting attachment engagement, the sensor operably coupled to an indicating device, the indicating device effective to provide an indication to an operator of the drum lifting equipment that the clamp has effectively engaged the drum.

24. The device of claim 23 wherein the sensor signal terminates when the clamp disengages the drum and wherein the termination of the signal deactivates the indicator indicating to an operator that the drum has been properly deposited and disengaged.

* * * * *